United States Patent [19]

McClenathan

[11] Patent Number: 4,529,141

[45] Date of Patent: Jul. 16, 1985

[54] METHOD AND APPARATUS FOR REWINDING, SEVERING AND TRANSFERRING WEB-LIKE MATERIAL

[75] Inventor: John A. McClenathan, Oneonta, Ala.

[73] Assignee: IMD Corporation, Birmingham, Ala.

[21] Appl. No.: 570,365

[22] Filed: Jan. 13, 1984

[51] Int. Cl.[3] ..... B26D 1/56; B65H 19/20

[52] U.S. Cl. ..... 242/56 A; 83/338

[58] Field of Search ..... 242/56 R, 56 A; 226/95; 83/337, 338

[56] References Cited

U.S. PATENT DOCUMENTS

| | | | |
|---|---|---|---|
| 1,945,248 | 1/1934 | Winkler et al. | 271/95 |
| 3,086,725 | 4/1963 | Zernov | 242/56 A |
| 3,377,032 | 4/1968 | Jacobs et al. | 242/56 A |
| 3,552,670 | 1/1971 | Herman | 242/56 A |
| 3,592,403 | 7/1971 | Schmitt | 242/56 R |
| 3,641,857 | 2/1972 | Vande Castle | 83/337 X |
| 3,741,453 | 6/1973 | Pierce et al. | 226/95 X |
| 3,869,095 | 3/1975 | Diltz | 242/66 X |

*Primary Examiner*—Stuart S. Levy
*Assistant Examiner*—Lynn M. Sohacki
*Attorney, Agent, or Firm*—Woodford R. Thompson, Jr.

[57] ABSTRACT

A method and apparatus for rewinding and severing a web delivered to a winding core and then transferring the leading end of the remaining web to an empty core while the winding core is being filled. The web to be rewound and severed is passed between a vacuum transfer roll and a knife roll prior to reaching the winding core with the vacuum transfer roll being spaced from the winding core while the web is delivered thereto until such winding core is almost filled. The vacuum transfer roll is moved toward engagement with the empty core and the knife roll is moved toward the vacuum transfer roll when the winding core is almost filled. The web is severed at a location spaced forwardly of the empty core as it passes between the vacuum transfer roll and the knife roll with the vacuum transfer roll being adjacent the empty core to force the leading end of the remaining web onto the empty core.

21 Claims, 11 Drawing Figures

METHOD AND APPARATUS FOR REWINDING, SEVERING AND TRANSFERRING WEB-LIKE MATERIAL

BACKGROUND OF THE INVENTION

This invention relates to a method and apparatus for rewinding, severing and transferring web-like material and more particularly to a method and apparatus for rewinding and severing a web delivered to a winding core and transferring or attaching the leading end of the remaining web to an empty core while the winding core is being filled.

Heretofore in the web coating or process industry, difficulties have been encountered in keeping the process machine running continuously without having to stop and start the machine each time the processed roll of web-like material, such as a web of magnetic tape, paper, film, foil or the like has become depleted. To accomplish this, many methods have been proposed for attaching the web to an empty core after the in-process core has been filled. Also, the web of processed tape-like material has heretofore been cut while tension is applied to the web, thus damaging or impairing the quality of the web.

Difficulties have also been encountered in maintaining the leading cut end or edge of the web under control at all times during transfer to an empty core. This is especially true in view of the fact that the leading cut edge must be wrapped onto the empty core without fold back and without wrinkles. While the Winkler U.S. Pat. No 1,945,248 and the Pierce et al U.S. Pat. No. 3,741,453 disclose the broad concept of employing a suction roller for removing sheet-like members from a stack thereof and a perforated drum for holding a strand of synthetic fiber in place, respectively, they do not suggest my improved method and apparatus.

SUMMARY OF THE INVENTION

To overcome the above and other difficulties, I provide an improved method and apparatus for rewinding, severing and transferring web-like members wherein the leading cut edge of the web is maintained under positive control at all times during the transfer to an empty core. Accordingly, the leading cut edge is wrapped onto the empty core without fold back or wrinkles, which is mandatory for the production of many products or tapes, such as magnetic tapes.

Another object of my invention is to provide a method and apparatus of the character designated wherein the web is severed or spliced with no interruption in the rewind process and at the same time, an accurate cut is made in spaced relation to the empty core as distinguished from cuts made by conventional apparatus wherein the cut is made in mid-air under high tension. That is, in accordance with my improved process and apparatus, the web is handled under relatively low tension and at the same time, the leading edge of the web is under control at all times without fold back or wrinkles.

Another object of my invention is to provide a method and apparatus of the character designated which is adapted to cut very thick and heavy webs of material and does not damage any coating applied thereto.

A still further object of my invention is to provide improved knife actuator means which moves the web severing knife radially and axially into engagement with an anvil recess extending longitudinally of the vacuum transfer roll.

In accordance with one embodiment of my invention, I provide a method and apparatus for rewinding and severing a web delivered to a winding core at a first core station on a rotatable turret having a second core station spaced angularly from the first core station and carrying an empty core. After severing the web, the leading end of the remaining web is transferred to an empty core while the winding core is being filled. The web is first passed between a vacuum transfer roll and a knife roll prior to reaching the winding core at the first core station with the vacuum transfer roll being spaced from or nipped against the winding core while the web is delivered thereto until the winding core is almost filled. A rotatable turret moves the winding core as it is about to be filled to the second core station as the empty core is moved from the second core station to the first mentioned core station. The vacuum transfer roll is moved toward engagement with the empty core while it is at the first mentioned core station and the knife roll is moved toward the vacuum transfer roll when the winding core is almost filled. The web is severed at a location spaced forwardly of the empty core as it passes between the vacuum transfer roll and the knife roll with the vacuum transfer roll being adjacent the empty core to force the leading end of the remaining web onto the empty core at the first mentioned core station.

BRIEF DESCRIPTION OF DRAWINGS

Apparatus embodying features of my invention and which may be employed to carry out my improved process is shown in the accompanying drawings, forming a part of this application, in which.

DETAILED DESCRIPTION

Figure 2:
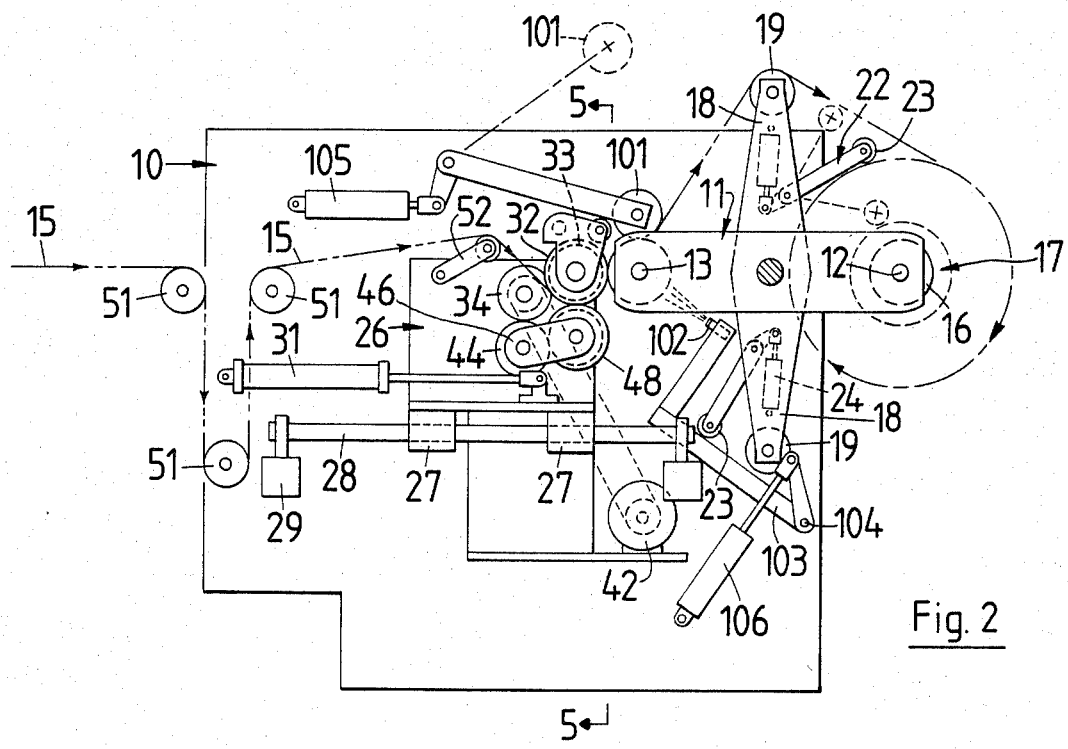
FIG. 2 is a diagrammatic, side elevational view corresponding to FIG. 1 showing the vacuum transfer roll and the knife roll in position to sever the web and transfer the leading end of the remaining web onto an empty core.
Figure 1:
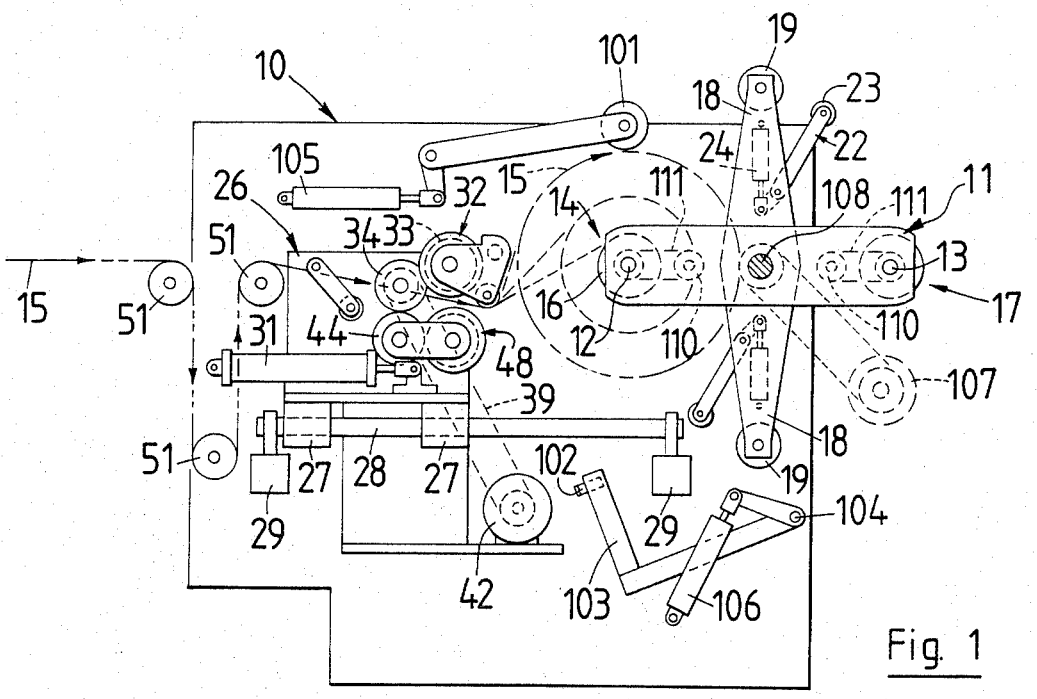
FIG. 1 is a diagrammatic, side elevational view, with parts being omitted for the sake of clarity, showing the web being wound onto a winding core.

Referring now to the drawings for a better understanding of my invention, I show a supporting frame diagrammatically at 10. Mounted for rotation on the supporting frame 10 is a rotatable turret 11 having a first core station 12 and a second core station 13 which are spaced angularly from each other, as shown in FIGS. 1 and 2. That is, the core stations 12 and 13 are spaced from each other an angular distance of 180° whereby upon rotating the turret 11 180°, the core station 12 moves to the position previously occupied by core station 13 and core station 13 then occupies the space previously occupied by core station 12. Each of the core stations 12 and 13 is adapted to move to a first position 14 to receive a web 15 delivered to its winding core 16 until it is almost filled, as indicated by the dot-dash line shown in FIG. 1. Upon rotation of the turret 11 from the position shown in FIG. 1 to the position shown in FIG. 2, the core station 12 moves from the first position 14 to a second position 17 while the core station 13 moves from the second position 17 to the first position 14, as shown in FIG. 2. Accordingly, the first position 14 is spaced from the second position 17 an angular distance corresponding to the angular distance between the first core station 12 and the second core station 13. As shown in FIGS. 1 and 2, the turret 11 carries diametrically disposed arms 18 which project outwardly from the turret 11 whereby they are positioned an angular distance of 90° from each of the core stations 12 and 13. Each arm carries an idler roll 19 at the outer end thereof in position to receive the web 15 as the almost filled core 16 is transferred from the position shown in FIG. 1 to the position shown in FIG. 2.

Pivotally connected to each arm 18 is an auxiliary lay-on roll assembly 22 having an auxiliary lay-on roll 23 which is adapted to engage the outer surface of the web 15 applied to the winding core 16 after it is transferred from the position shown in FIG. 1 to the position shown in FIG. 2. The auxiliary lay-on roll assembly 22 is moved toward and away from the winding core 16 by suitable means, such as a fluid pressure operated unit indicated generally at 24.

Figure 5:
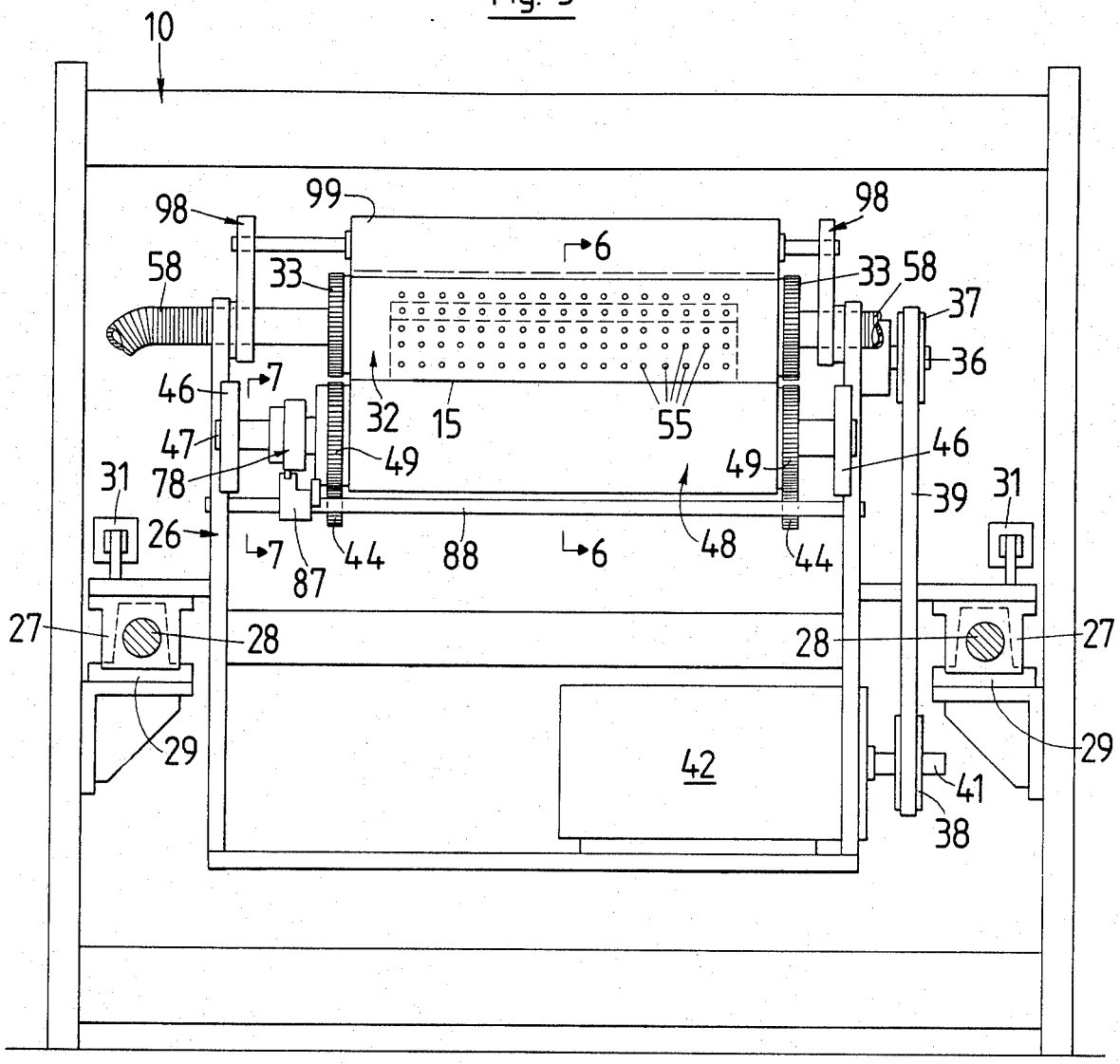
FIG. 5 is an enlarged, sectional view taken generally along the line 5—5 of FIG. 2, partly broken away and in section.

Mounted for movement selectively in a first direction away from the first position 14 of the core stations 12 and 13 and in a second direction toward such first position 14 is a carriage 26. As shown in FIGS. 1, 2 and 5, bearing members 27 are carried by each side of the carriage 26 in position to ride along elongated shaft-like members 28 which extend parallel to each other and are supported at opposite ends by support brackets 29. The carriage 26 is moved along the shaft-like members by suitable means, such as a fluid pressure operated unit indicated generally at 31. Mounted for rotation in suitable bearings carried by the carriage 26 is an elongated vacuum transfer roll 32 which carries a gear 33 at opposite ends thereof, as shown in FIG. 5. Each gear 33 is in driving engagement with a drive gear 34 which is mounted on a drive shaft 36. The drive shaft 36 carries a pulley 37 which is driven by a drive pulley 38 through a drive belt 39. The drive pulley 38 is mounted on a drive shaft 41 of a suitable power unit, such as an electric motor 42.

Mounted on the carriage 26 is an elongated fixed shaft 43 which carries spaced apart idler gears 44 which are mounted in position to mesh with the gears 34 carried by the shaft 36. Mounted for pivotal movement relative to the fixed shaft 43 are spaced apart support arms 46 which support an elongated shaft 47. Mounted for rotation on the shaft 47 is an elongated knife roll 48. Gear members 49 are carried by opposite ends of the knife roll, as shown in FIG. 5 in a position to mesh with the gears 44 mounted on the shaft 43. Accordingly, the gears 49 carried by the knife roll are driven by the gears 44 which in turn are driven by the drive gear 34. By supporting the knife roll 48 and its gears 49 on the support arms 46 for pivotal movement relative to the shaft 43, the knife roll is adapted to move selectively to a position in space relation to the vacuum transfer roll 32, as shown in FIG. 1, and to a position adjacent to the vacuum transfer roll 32, as shown in FIG. 2.

Figure 3:
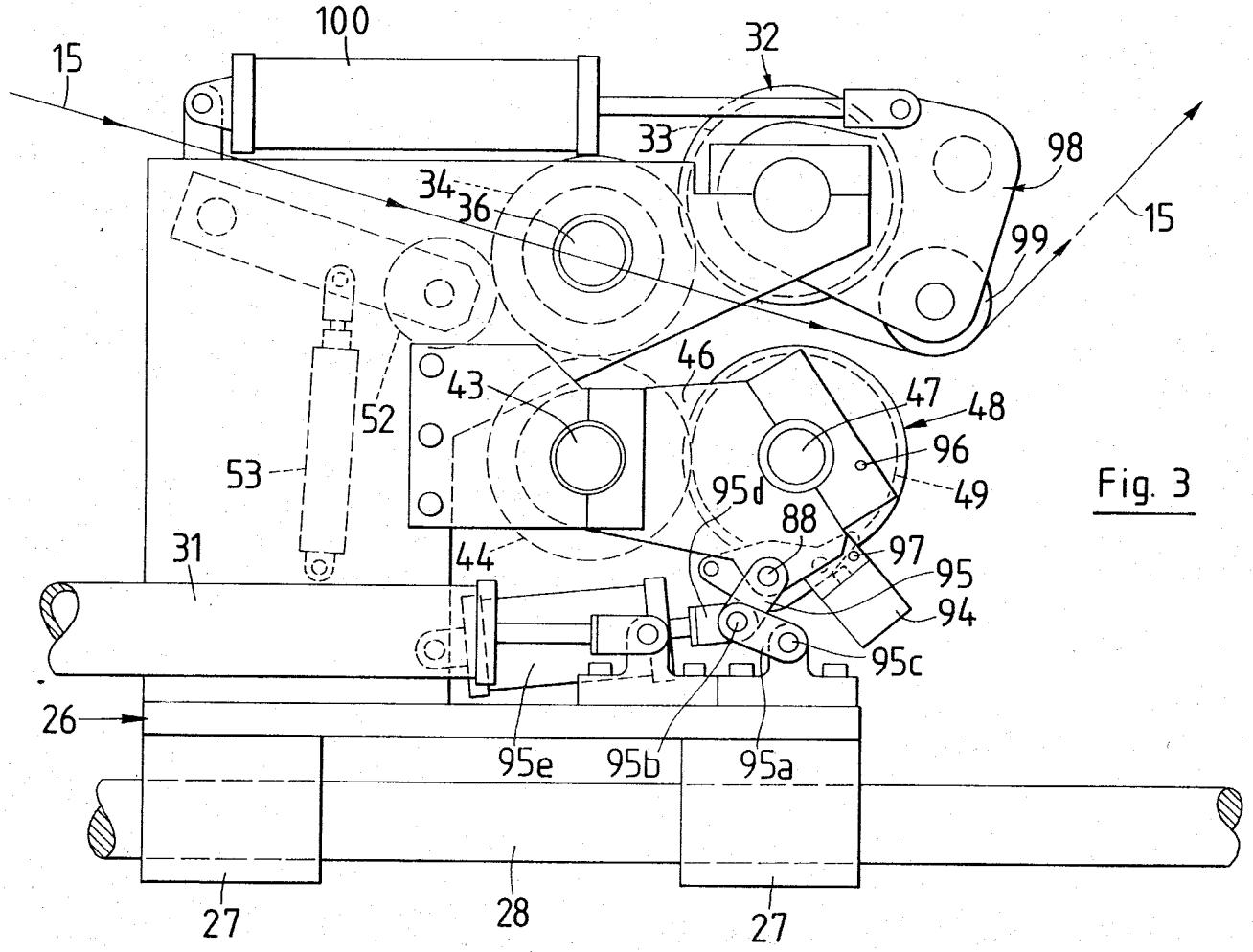
FIG. 3 is an enlarged, fragmental view, partly broken away and in section, showing the knife roll in spaced relation to the vacuum transfer roll with the transfer idler roll in position to deliver the web to a winding core.
Figure 4:
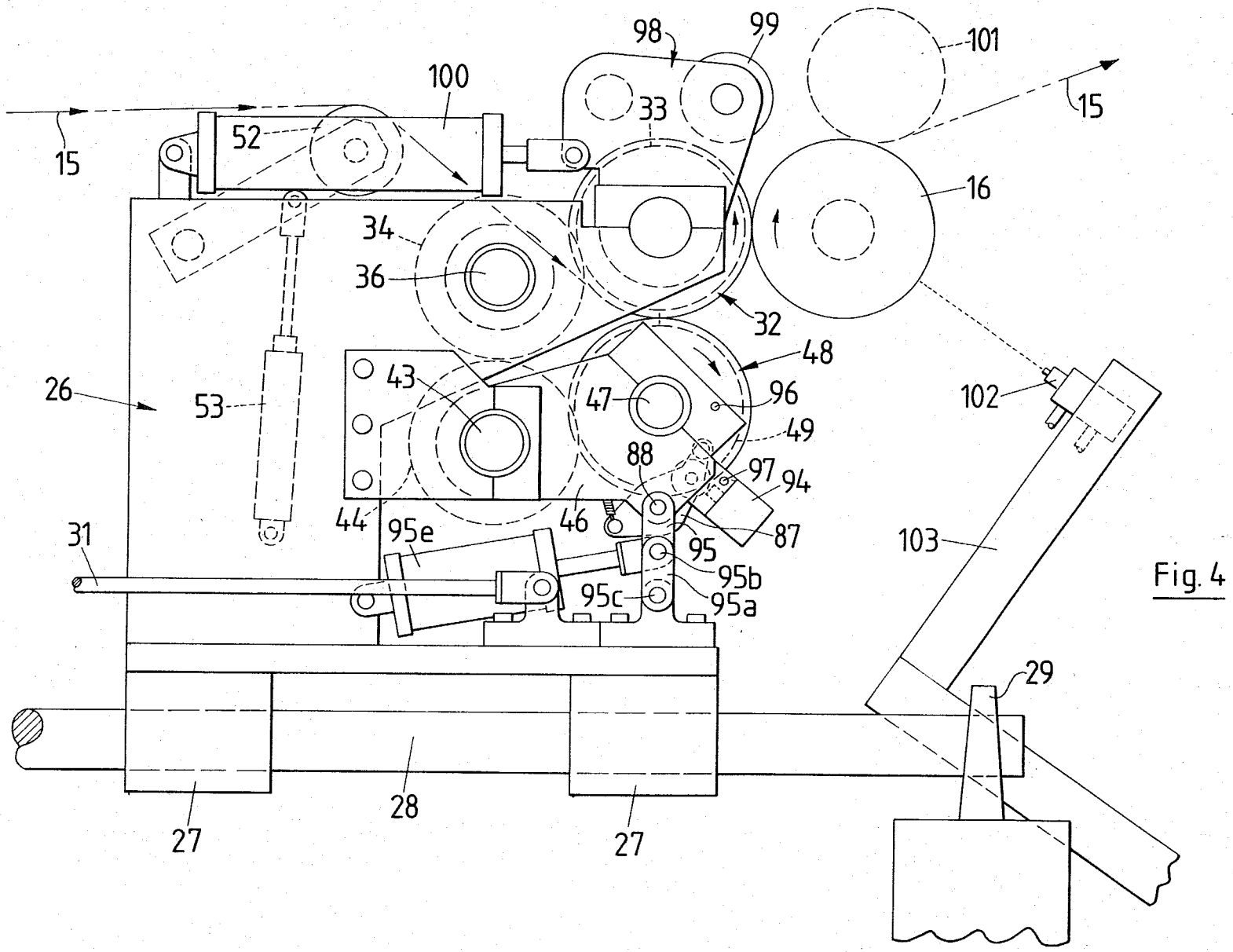
FIG. 4 is an enlarged, fragmental view, partly broken away and in section, showing the knife roll moved into engagement with the vacuum transfer roll with the web passing therebetween and showing the transfer idler roll pivoted to its inoperative position.

As the web 15 enters the rewind apparatus, it passes around conventional idlers 51 and an idler roll assembly 52 which is adapted to move selectively to the position shown in FIG. 1 and the position shown in FIG. 2. As shown in FIGS. 3 and 4, a suitable fluid pressure operated cylinder 53 may be employed to move the idler roll assembly 52 to the various positions to assure proper web wrap on the vacuum transfer roll and to maintain proper tension to the web as it is delivered to the winding core 16.

Figure 6:
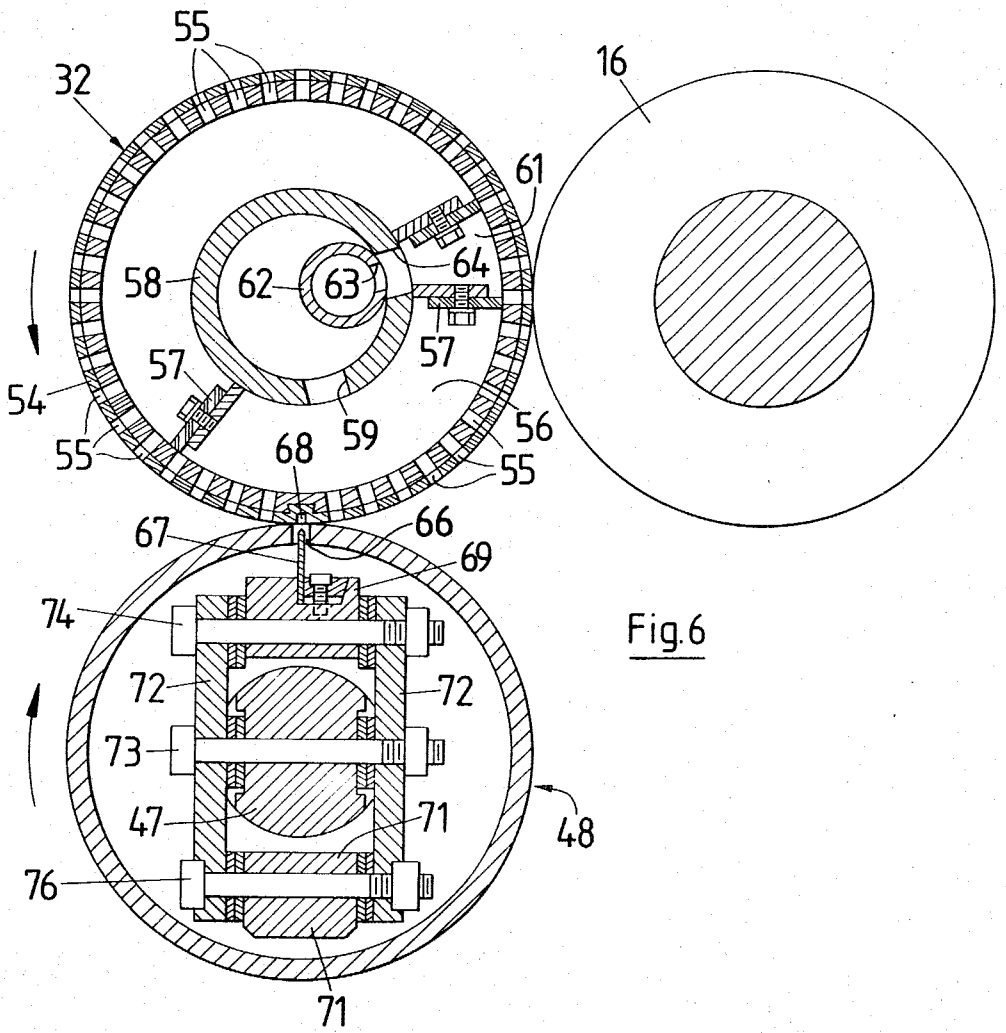
FIG. 6 is an enlarged, sectional view taken generally along the line 6—6 of FIG. 5 with parts being omitted for the sake of clarity.

As shown in FIGS. 5 and 6, the vacuum transfer roll 32 is shown as being an elongated cylinder 54 having perforations 55 around the entire periphery thereof. The perforated cylinder is mounted for rotation about an outwardly opening, stationary vacuum chamber 56 which extends an angular distance from a point adjacent the initial point of contact of the web 15 with the vacuum transfer roll to a point just before contact of the vacuum transfer roll with the empty core 16 at the first position 14 of the core stations 12 and 13. Accordingly, a negative pressure is provided within the vacuum chamber 56 to provide positive control of the web 15 before and just after the web 15 is severed in a manner to be described hereinafter. The vacuum chamber 56 is shown as being defined by radially extending, elongated partition members 57 which extend between the inner surface of the perforated cylinder 54 and the outer surface of a centrally disposed vacuum conduit 58, as clearly shown in FIG. 6. A passageway 59 is provided through the vacuum conduit 58 whereby air passes inwardly of the vacuum conduit 58 to create a negative pressure within the vacuum chamber 56.

As shown in FIG. 6, an outwardly opening, stationary pressure chamber 61 is also provided within the vacuum transfer roller 32. The pressure chamber 61 extends an angular distance in the direction of rotation of the vacuum transfer roll 32 from a point just before contact of the vacuum transfer roll 32 with the winding core 16 at the first position 14 of the core stations 12 and 13 whereby a positive pressure is provided in the pressure chamber 61 to aid in forcing the severed leading end of the remaining web 15 onto an empty core at the first position 14 of the core stations 12 and 13. Air under pressure is supplied to the pressure chamber 61 by a suitable air supply conduit 62 which may be mounted within the vacuum conduit 58, with there being passageways 63 and 64 through the air supply conduit 62 and the vacuum conduit 58 for delivering the air under pressure into the pressure chamber 61.

Figure 8:
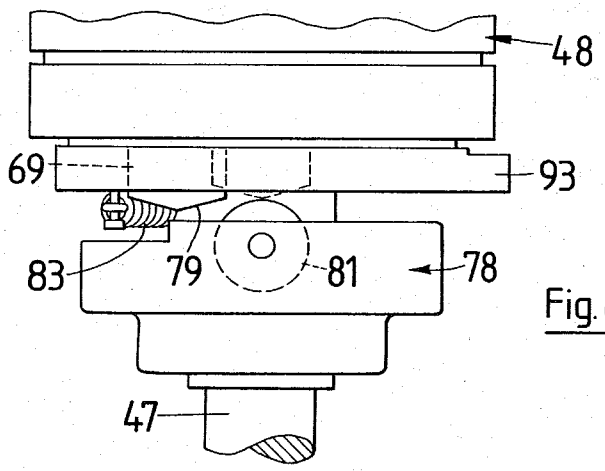
FIG. 8 is a fragmental view, partly broken away and in section, taken generally along the line 8—8 of FIG. 7, with parts being omitted for the sake of clarity.
Figure 9:
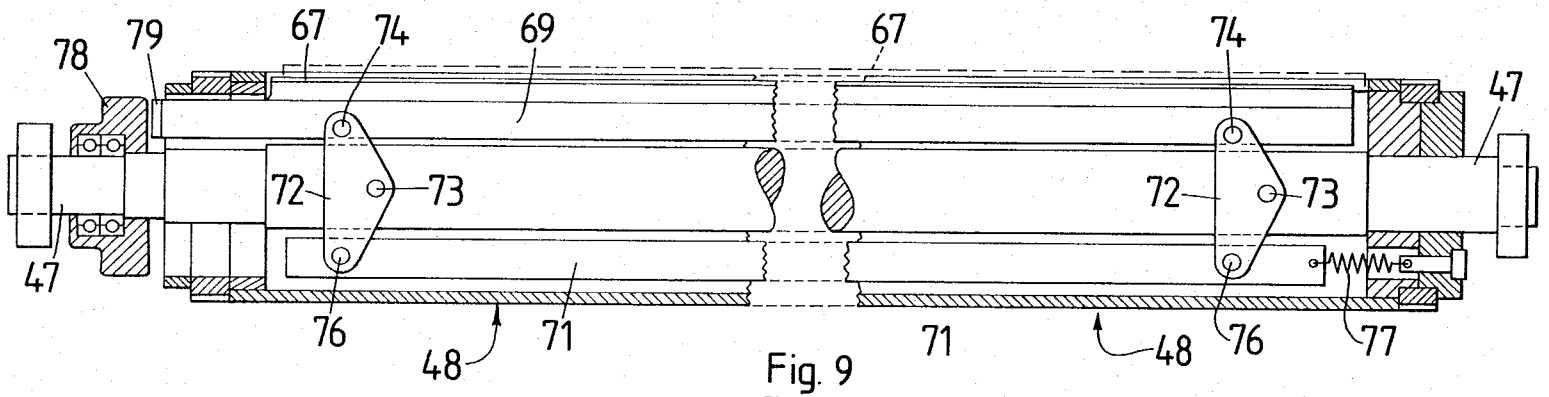
FIG. 9 is a vertical sectional view through the knife roll showing the means for moving the knife blade selectively to a position inwardly of the knife roll and to a position outwardly thereof.
Figure 11:
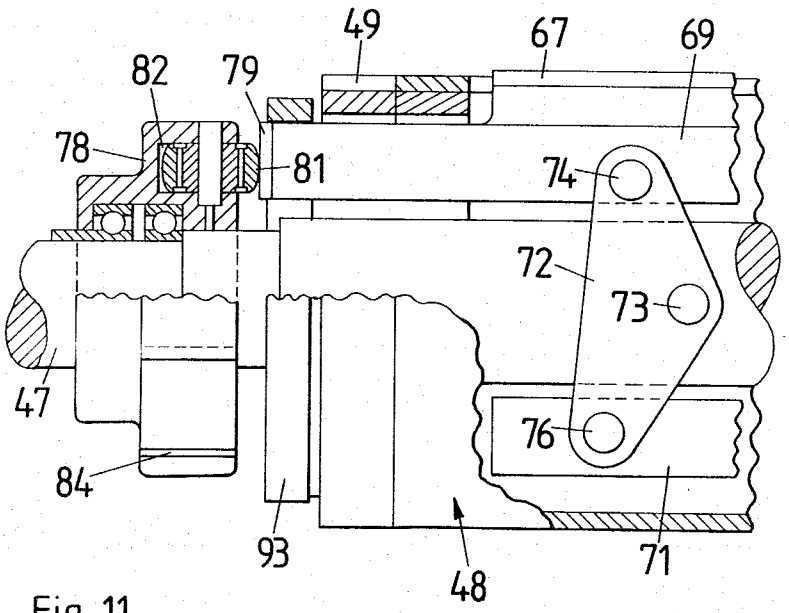
Figure 10:
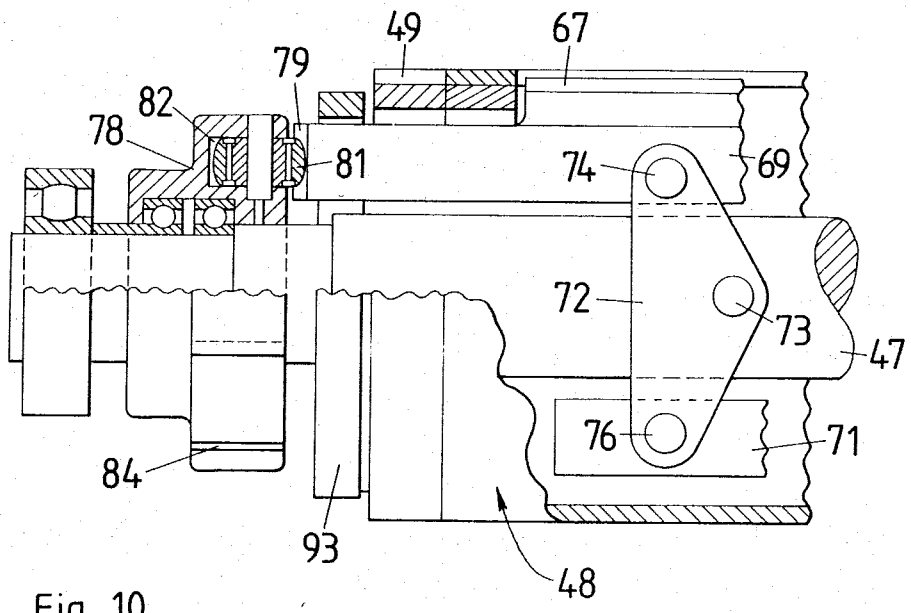
FIG. 10 is an enlarged, fragmental view, partly broken away and in section, showing the knife blade positioned inwardly of the knife roll; and, FIG. 11 is an enlarged, fragmental view showing the knife blade moved to a position outwardly of the outer surface of the knife roll.

As shown in FIGS. 6–11, the knife roll 48 is shown as being in the form of a cylindrical drum having a longitudinally extending slot 66 therethrough for receiving an elongated knife blade 67. The knife blade is adapted to move axially and radially toward an elongated anvil recess 68 which extends longitudinally of the vacuum transfer roll 32 in position to receive the elongated knife blade 67, as shown in FIG. 6. The knife blade 67 is carried by an elongated bar 69 which extends parallel to the shaft 47 for the knife roll 48, as shown in FIG. 6. A second elongated bar 71 is mounted within the knife roll 48 and extends parallel to and at the opposite side of the shaft 47 from the elongated bar 69. Longitudinally spaced pivot arms 72 are pivotally connected at their centers to the knife roll shaft 47 by pivot pins 73, as shown in FIGS. 6–11. One end of each pivot arm 72 is pivotally connected to the elongated bar 69 by a pivot pin 74 while the other end thereof is pivotally connected by a pivot pin 76 to the elongated bar 71. Accordingly, a parallelogram arrangement is provided whereby upon movement of the bar 69 axially or longitudinally of the knife roll 48, the knife blade 67 moves from the position shown in FIG. 10 to the position shown in FIG. 11. That is, the knife blade 67 moves from a position within the confines of the knife roll 48 to a position outwardly thereof as the elongated bar 69 is moved toward the right, as viewed in FIG. 9. Also, as the elongated bar 69 is moved relative to the pivot pin 73, the elongated bar 69 and the knife blade 67 carried thereby, move axially and radially toward engagement with the anvil recess 68 in the vacuum transfer roll 32. In like manner, upon moving the elongated bar 69 toward the left, as viewed in FIG. 9, the knife blade 67 is retracted from the anvil recess 68 and then moves inwardly of the knife roll 48. As shown in FIG. 9, a tension spring 77 is interposed between one end of the elongated bar 71 and the adjacent end of the knife roll to urge the bar 71 toward the right, as viewed in FIG. 9, whereby the knife blade 67 is returned to the solid line position within the confines of the knife roll 48 after actuation of the knife blade 67.

Figure 7:
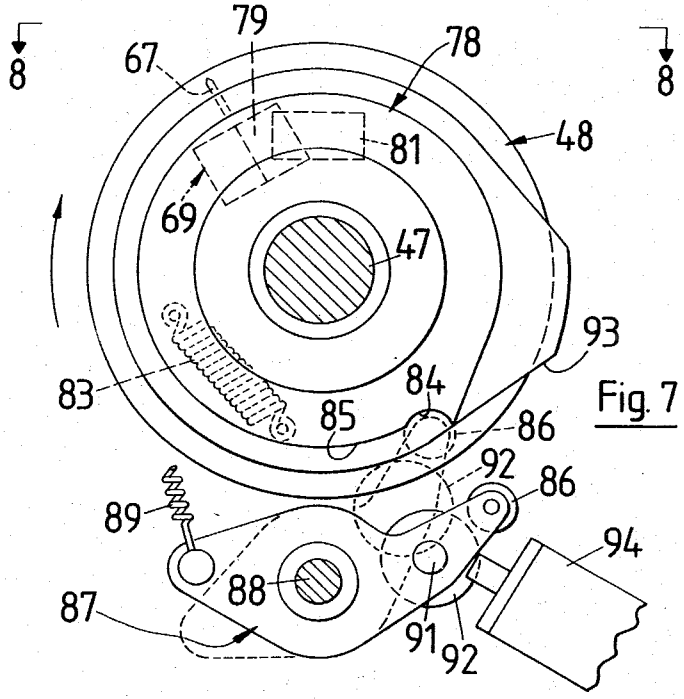
FIG. 7 is an enlarged, fragmental sectional view taken generally along the line 7—7 of FIG. 5.

To move the elongated bar 69 toward the right, as viewed in FIG. 9, to actuate the knife blade 67, a clutch unit 78 is mounted non-rotatably on the knife roll shaft 47. The end of the elongated bar 69 adjacent the clutch unit 78 projects outwardly of the knife roll 48 toward the clutch unit with the outermost end of the elongated bar 69 having an outwardly converging cam surface 79 in position to engage a cam roller 81 mounted for rotation within a recess 82 provided in the housing for the clutch unit 78, as shown in FIGS. 7, 8, 10 and 11. A tension spring 83 is connected at one end to the clutch unit 78 with the other end thereof being connected to the adjacent end of the knife roll 48, as shown in FIGS. 7 and 8, whereby the clutch unit 78 is adapted to rotate along with the knife roll 48 and at the same time the tension spring 83 permits a limited amount of angular movement of the clutch unit 78 relative to the knife roll 48 and then returns the clutch unit 78 to the proper position to actuate the knife blade 67.

As shown in FIG. 7, an outwardly sloping cam notch 84 is provided in the outer surface of the clutch unit 78 in position to receive a cam roller 86 carried by one end of a knife actuator member 87 which is mounted for pivotal movement about a supporting shaft-like member 88 carried by the carriage 26, as shown in FIGS. 5 and 7. The other end of the knife actuator member 87 is connected to one end of a tension spring 89 with the other end of the spring 89 being anchored to the carriage 26 in a suitable manner. Mounted for rotation on the knife actuator member 87 by means of a pivot pin 91 is a cam roller 92 which is shown as being larger in diameter than the cam roller 86. As shown in FIG. 7 and 8, a cam member 93 is carried by the knife roll 48 in position to engage the larger diameter cam roller 92 to disengage the knife actuator member 87 after the web 15 has been severed. The knife actuator member 87 is activated by a solenoid unit 94 which is adapted to pivot the knife actuator member in a counterclockwise direction, as viewed in FIG. 7. to move the cam rollers 86 and 92 toward the cam notch 84 and cam surface 93, respectively.

As shown in FIGS. 3 and 4, a photo-optic unit 96 is mounted adjacent the knife roll 48 so that when a signal is given to actuate the knife blade 67, the circuit to the solenoid unit 94 is not completed until the photo-optic unit 96 detects that the knife roll 48 has rotated to a position to allow at least one revolution of the knife roll after the signal is given. This assures that the cam notch 84 has not moved beyond its position of engagement with the cam roller 86 when the solenoid unit 94 is actuated. That is, this allows sufficient time for the cam roller 86 to be seated properly against a cam surface 85 defined by the outer surface of the clutch housing 78 when the cam notch 84 again rotates to its position of engagement with the cam roller 86. As shown in FIGS. 3 and 4, a photo-optic unit 97 is mounted in position to de-energize the solenoid 94 after the knife actuator member 87 has actuated the knife blade 67 to sever the web.

As shown in FIGS. 3 and 4, one end of a link 95 is pivotally connected to the shaft-like member 88 with the other end of the link 95 being pivotally connected to one end of another link **95*a* by a pivot pin 95*b*. The other end of the link 95*a* is pivotally connected to the carriage 26 by a pivot pin 95*c*. Pivotally connected to the pivot pin 95*b* by a clevis connection 95*d* is a fluid pressure operated unit 95*e* which is adapted to move the links 95 and 95*a* selectively to the position shown in FIG. 3 and to the position shown in FIG. 4. That is, as the links 95 and 95*a* are moved to the position shown in FIG. 3, the support arms 46 carrying the knife roll 48 are moved to position the knife roll in spaced relation to the vacuum transfer roll 32. Upon movement of the links 95 and 95*a* to the position shown in FIG. 4 the knife roll 48 is moved into engagement with the vacuum transfer roll 32 with the web 15** therebetween.

From the foregoing, the operation of the knife roll unit will be readily understood. Since the clutch housing 78 is not fixed to the knife roll shaft 47, it rotates along with the knife roll 48 through its connection thereto by the tension spring 83. At the time a signal is given to actuate the knife blade 67, the circuit to the solenoid 94 is not completed immediately. When the photo cell 96 detects that the knife roll has rotated to a position to allow one free revolution after the signal is given, the solenoid 94 is actuated to move the cam roller 86 into engagement with the cam notch 84, thus preventing rotation of the clutch unit 78 relative to the knife roll 48. Continued rotation of the knife roll 48 causes the tension spring 83 to be extended as the cam surface 79 moves relative to the cam roller 81 to thus force the elongated bar member 69 toward the right, as viewed in FIGS. 9–11, to thereby move the knife blade 67 radially and axially toward engagement with the anvil recess 68 carried by the vacuum transfer roll 32. Further rotation of the knife roll 48 causes the cam 93 to engage the larger diameter cam roller 92 and thus move the knife actuator member 87 in a clockwise direction, as viewed in FIG. 7, to move the cam roller 86 out of engagement with the cam notch 84, thus releasing the clutch 78 for free rotation along with the knife roll 48, as described hereinabove. The knife blade 67 is returned to the inoperative position by the tension spring 77, as shown in FIG. 9.

As shown in FIGS. 1–5, a transfer idler assembly 98, having an idler roll 99, is mounted for pivotal movement relative to the vacuum transfer roll 32 selectively to a first positon, shown in FIG. 3, in engagement with the web 15 prior to delivery thereof to the winding core 16 at the first position 14 of the core stations 12 and 13 while the vacuum transfer roll 32 is in a position space from the knife roll 48 and the winding core 16 and to a second position, shown in FIG. 4, out of engagement with the web 15 while the vacuum transfer roll 32 is in a position adjacent an empty core at the first position 14 of the core stations. The idler assembly 98 is moved to selected positions by suitable means, such as a fluid pressure operated unit 100.

As shown in FIGS. 1 and 2, a lay-on roll 101 is mounted for movement to a position in contact with the web 15 wound onto the winding core 16 at the first position 14 of the core stations 12 and 13 until the winding core 16 is almost filled and the turret 11 is rotated to move the winding core 16 located at the first station 14 to the second station 17 of the core stations. The lay-on roll 101 is moved to selected positions by suitable means, such as by a fluid pressure unit indicated generally at 105.

As shown in FIGS. 1 and 2, a suitable spray manifold 102 is mounted for movement to an operative position to apply an adhering agent, such as a suitable liquid or adhesive, to the outer surface of an empty core at the first position 14 of the core stations 12 and 13 prior to receiving the leading end of the remaining web 15 after the web has been severed. The spray manifold 102 is carried by an arm 103 which is pivotally connected to the housing 10 as at 104. A suitable fluid pressure operated unit 106 may be employed to move the spray manifold 102 from the operative position shown in FIG. 2 to an inoperative position, as shown in FIG. 1.

As shown in FIG. 1, the turret 11 may be driven by suitable means, such as by a motor 107 which is operatively connected to a centrally disposed shaft 108 for the turret. Also, each winding core 16 at the core stations 12 and 13 may be driven by suitable means, such as a motor unit 110 operatively connected by a flexible drive 111 to the drive spindle for the core 16. In view of the fact that such drive means for the turret 11 and the individual winding core 16 is conventional apparatus well known in the art to which my invention relates, no further description thereof is deemed necessary.

From the foregoing, the construction and operation of my improved apparatus and the manner in which my improved process is carried out will be readily understood. It will also be seen that I have devised an improved method and apparatus for rewinding, severing, and transferring web-like material wherein the web is delivered to a winding core carried by one core station of a rotatable turret and the leading edge of the remaining web is transferred to and attached to an empty core while the winding core is being filled. Also, by severing the web without interruption in the rewind process with an accurate cut being made in spaced relation to the empty core, the web is handled under relatively low tension and at the same time, the leading edge of the web is under control at all times without fold back or wrinkles. Also, by providing improved knife actuator means which moves the web severing knife radially and axially into engagement with an anvil recess extending longitudinally of a vacuum transfer roll, the web is cut accurately and at the same time the apparatus is adapted to cut very thick and heavy webs of material without damage to the web or any coating applied thereto. Furthermore, my improved apparatus is adapted for use with cores of various sizes, thus eliminating difficulties heretofore encountered with conventional apparatus which is adapted for use only on cores of the same size.

While I have shown the rotatable turret as having only one core station for receiving an empty core, it will be obvious that the turret could carry one, two or more such core stations. Also, instead of employing a rotatable turret, suitable means may be employed to impart relative movement selectively between the vacuum transfer roll and a winding core at one fixed core station and between the vacuum transfer roll and an empty core at another fixed core station.

While I have shown my invention in but one form, it will be obvious to those skilled in the art that it is not so limited, but is susceptible of various changes and modifications without departing from the spirit thereof.

What I claim is:

1. A method for rewinding and severing a web delivered to a winding core and then transferring the leading end of the remaining web to an empty core while said winding core is being filled comprising the steps of:

(a) passing said web between a vacuum transfer roll and a knife roll prior to reaching said winding core with said vacuum transfer roll being spaced from said winding core while said web is delivered thereto until said winding core is almost filled, (b) imparting relative movement between said vacuum transfer roll and said empty core to position said vacuum transfer roll in engagement with said empty core when said winding core is almost filled, (c) moving said knife roll toward engagement with said vacuum transfer roll with said web therebetween while said vacuum transfer roll is adjacent said empty core, and (d) severing said web as it passes between said vacuum transfer roll and said knife roll with said vacuum transfer roll adjacent said empty core so that said web is severed at a location spaced forwardly of said empty core as viewed in the direction of travel of said web and the leading end of the remaining web is forced onto said empty core.

2. A method for rewinding and severing a web delivered to a winding core carried by one core station of a rotatable turret having at least one other core station spaced angularly from said one core station and carrying an empty core and then transferring the leading end of the remaining web to said empty core while said winding core is being filled comprising the steps of:

(a) passing said web between a vacuum transfer roll and a knife roll prior to reaching said winding core at said one core station with said vacuum transfer roll being spaced from said winding core while said web is delivered thereto until said winding core is almost filled, (b) rotating said rotatable turret to move said winding core to said other core station as an empty core is moved from said other core station to said one core station, (c) moving said vacuum transfer roll toward engagement with said empty core at said one core station when said winding core is almost filled, (d) moving said knife roll toward engagement with said vacuum transfer roll with said web therebetween while said vacuum transfer roll is adjacent said empty core, and (e) severing said web as it passes between said vacuum transfer roll and said knife roll with said vacuum transfer roll adjacent said empty core at said one core station so that said web is severed at a location spaced forwardly of said empty core as viewed in the direction of travel of said web and the leading end of the remaining web is forced onto said empty core.

3. The method as defined in claim 2 in which an adhering agent is applied to the outer surface of said empty core at said one core station prior to forcing said leading end of the remaining web onto said empty core.

4. Apparatus for rewinding and severing a web delivered to a winding core and then transferring the leading end of the remaining web to an empty core while said winding core is being filled comprising:

(a) means to pass said web between a vacuum transfer roll and a knife roll prior to reaching said winding core with said vacuum transfer roll being spaced from said winding core while said web is delivered thereto until said winding core is almost filled, (b) means to impart relative movement between said vacuum transfer roll and said empty core to position said vacuum transfer roll in engagement with said empty core when said winding core is almost filled, (c) means to move said knife roll toward engagement with said vacuum transfer roll with said web therebetween while said vacuum transfer roll is ajdacent said empty core, and (d) means to sever said web as it passes between said vacuum transfer roll and said knife roll with said vacuum transfer roll adjacent said empty core so that said web is severed at a location spaced forwardly of said empty core as viewed in the direction of travel of said web and the leading end of the remaining web is forced onto said empty core.

5. Apparatus for rewinding and severing a web delivered to a winding core and then transferring the leading end of the remaining web to an empty core while said winding core is being filled comprising:

(a) a rotatable turret carrying a first core station and at least one other core station spaced angularly from each other with each of the core stations being adapted to move to a first position to receive a web delivered to its winding core until it is almost filled and then prior to and during severing of its web to a second position which is spaced from said first position an angular distance corresponding to the angular distance between said first core station and said other core station, (b) a vacuum transfer roll movable to a first location spaced from said first position of said core stations while said web is being delivered to a winding core at said first position until it is almost filled and then prior to and while said web is severed is movable to a second location adjacent the empty core at said first position, (c) a knife roll movable selectively to a first position spaced from said vacuum transfer roll while said web is being delivered therebetween to the winding core at said first position until it is almost filled and to a second position adjacent said vacuum transfer roll prior to and while said web is severed therebetween, (d) a knife carried by said knife roll and being movable toward said vacuum transfer roll to sever said web therebetween after movement of said vacuum transfer roll to said second location adjacent said empty core at said first position, and (e) means to rotate said turret to move the winding core at said first position to said second position prior to completely filling it and severing said web so that an empty core at said second position is moved to said first position of said core stations and receives said leading end of the remaining web after said web is severed.

6. Apparatus as defined in claim 5 in which said vacuum transfer roll and said knife roll are carried by a carriage which is mounted for movement selectively in a first direction away from said first position of said core stations while said web is being delivered to said winding core and until said winding core is almost filled and in a second direction toward said first position of said core stations prior to and while said web is being severed.

7. Apparatus as defined in claim 5 in which said vacuum transfer roll comprises:

(a) a perforated cylinder mounted for rotation about an outwardly opening stationary vacuum chamber extending an angular distance from a point adjacent the initial point of contact of the web with said vacuum transfer roll to a point just before contact of said vacuum transfer roll with the empty core at said first position of said core stations so that a negative pressure is provided within said vacuum chamber to provide positive control of the web before and just after the web is severed, and (b) an outwardly opening stationary pressure chamber extending an angular distance in the direction of rotation of the vacuum transfer roll from said point just before contact of said vacuum transfer roll with the empty core at said first position of said core stations so that a positive pressure is provided in said pressure chamber to aid in forcing the severed leading end of said remaining web onto an empty core at said first position of said core stations.

8. Apparatus as defined in claim 5 in which a transfer idler assembly is mounted for movement relative to said vacuum transfer roll and carries an idler roll which is movable selectively to a first position in engagement with said web prior to delivery thereof to said winding core at said first position of said core stations while said vacuum transfer roll is in said first location and to a second position out of engagement with said web while said vacuum transfer roll is in said second location adjacent said first position of said core stations and in contact with the empty core carried thereby.

9. Apparatus as defined in claim 5 in which a lay-on roll is mounted for movement to a position in contact with the web wound onto said winding core at said first position of said core stations until said winding core is almost filled and said turret is rotated to move said winding core located at said first position to said second position of said core stations.

10. Apparatus as defined in claim 5 in which an auxiliary lay-on roll is carried by said turret for movement into engagement with the web wound onto said winding core while it is in said second position of said core stations.

11. Apparatus as defined in claim 5 in which means is provided for applying an adhering agent to the outer surface of said empty core at said first position prior to receiving said leading end of the remaining web after the web is severed.

12. Apparatus as defined in claim 5 in which said knife is movable from a position inwardly of the outer surface of said knife roll to a position outwardly thereof and actuator means is operatively connected to said knife for moving said knife toward said vacuum transfer roll.

13. Apparatus as defined in claim 12 in which said knife carried by said knife roll comprises an elongated blade mounted for movement axially and radially toward said vacuum transfer roll.

14. Apparatus as defined in claim 13 in which an elongated anvil recess extends longitudinally of said vacuum transfer roll in position to receive said elongated blade.

15. Apparatus as defined in claim 14 in which said vacuum transfer roll and said knife roll are operatively connected in driving relation to each other to synchronize movement of said elongated blade and said elongated anvil recess so that they register with each other as said elongated blade moves toward said vacuum transfer roll and into said elongated anvil recess.

16. Apparatus as defined in claim 12 in which said knife is carried by an elongated member mounted for longitudinal movement within the confines of said knife roll and said actuator means comprises, (a) at least two longitudinally spaced arms with one end of each said arm being pivotally connected to said elongated member and another portion of each said arm being pivotally connected to a support within said knife roll and defining a parallelogram assembly wherein said elongated member and its knife is moved axially and radially toward and away from said vacuum transfer roll upon longitudinal movement of said elongated member to a first position and a second position respectively, and (b) means to move said elongated member selectively to said first position and said second position.

17. Apparatus as defined in claim 16 in which said support within said knife roll is a centrally disposed shaft for said knife roll.

18. Apparatus for rewinding and severing a web delivered to a winding core and then transferring the leading end of the remaining web to an empty core while said winding core is being filled comprising:

(a) a rotatable turret carrying a first core station and at least one other core station spaced angularly from each other with each of the core stations being adapted to move to a first position to receive a web delivered to its winding core until it is almost filled and then prior to and during severing of its web to a second position which is spaced from said first position an angular distance corresponding to the angular distance between said first core station and said other core station;

(b) a vacuum transfer roll movable to a first location spaced from said first position of said core stations while said web is being delivered to a winding core at said first position until it is almost filled and then prior to and while said web is severed is movable to a second location adjacent the empty core at said first position;

(c) a knife roll movably selectively to a first position spaced from said vacuum transfer roll while said web is being delivered therebetween to the winding core at said first position until it is almost filled and to a second position adjacent said vacuum transfer roll prior to and while said web is severed therebetween;

(d) a knife carried by said knife roll and being movable toward said vacuum transfer roll to sever said web therebetween after movement of said vacuum transfer roll to said second location adjacent said empty core at said first position, said knife being movable from a position inwardly of the outer surface of said knife roll to a position outwardly thereof and actuator means is operatively connected to said knife for moving said knife toward said vacuum transfer roll, said knife being carried by an elongated member mounted for longitudinal movement within the confines of said knife roll and said actuator means comprises, (i) at least two longitudinally spaced arms with one end of each arm being pivotally connected to said elongated member and another portion of each arm being pivotally connected to a centrally disposed shaft within said knife roll and defining a parallelogram assembly wherein said elongated member and its knife is moved axially and radially toward and away from said vacuum transfer roll upon longitudinal movement of said elongated member to a first position and a second position respectively, and (ii) means to move said elongated member selectively to said first position and said second position, comprising:

a cam surface on a projecting end of said elongated member, a clutch unit mounted on said shaft and adapted for relative angular movement therebetween, a cam member carried by said clutch unit in position to be engaged by said cam surface, and clutch operator means adapted to engage and disengage said clutch unit and restrain rotation of said clutch unit while it is engaged so that upon subsequent rotation of said knife roll said cam surface engages said cam member carried by said clutch unit and moves said elongated member to said first position and upon disengagement of said clutch unit said elongated member is returned to said second position; and (e) means to rotate said turret to move the winding core at said first position to said second position prior to completely filling it and severing said web so that an empty core at said second position is moved to said first position of said core stations and receives said leading end of the remaining web after said web is severed.

19. Apparatus as defined in claim 18 in which spring means moves said elongated member to said second position upon disengagement of said clutch unit.

20. Apparatus as defined in claim 18 in which said clutch operator means comprises a movable cam member adapted for movement into and out of engagement with a cam notch carried by said clutch unit so that upon engagement of said movable cam member with said cam notch angular movement of said clutch unit is restrained whereupon continued rotation of said knife roll moves said cam surface into engagement with said cam member carried by said clutch unit.

21. Apparatus as defined in claim 20 in which said movable can member is movable into engagement with said cam notch by a solenoid unit and is movable out of engagement with said cam notch by a disengagement cam member carried by said knife roll.

* * * * *